United States Patent [19]

Hernandez

[11] Patent Number: 4,798,285

[45] Date of Patent: Jan. 17, 1989

[54] BASKET-TYPE CARRIER FOR ELONGATED ARTICLES

[75] Inventor: Kenneth J. Hernandez, Monroe, La.

[73] Assignee: Manville Corporation, Denver, Colo.

[21] Appl. No.: 129,567

[22] Filed: Dec. 7, 1987

[51] Int. Cl.[4] ..... B65D 75/00

[52] U.S. Cl. ..... 206/180; 206/188; 206/427; 229/52 BC

[58] Field of Search ..... 206/171, 172, 173, 162, 206/175, 180, 188, 194, 427; 229/52 B, 52 BC

[56] References Cited

U.S. PATENT DOCUMENTS

| | | | |
|---|---|---|---|
| 3,152,719 | 10/1964 | Woodling | 206/173 |
| 3,202,313 | 8/1965 | Wainberg | 206/188 |
| 3,279,076 | 10/1966 | Graser | 206/173 |
| 3,375,968 | 4/1968 | Weiss | 206/139 |
| 3,458,035 | 7/1969 | Orthober | 206/431 |
| 3,572,545 | 3/1971 | Stout | 206/188 |
| 3,757,991 | 9/1973 | Stout | 206/173 |
| 3,814,237 | 6/1974 | Forrer | 206/167 |
| 4,308,950 | 1/1982 | Wood | 206/188 |
| 4,402,400 | 9/1983 | Stout | 229/52 BC |

FOREIGN PATENT DOCUMENTS

| | | | |
|---|---|---|---|
| 2711632 | 9/1978 | Fed. Rep. of Germany | 206/427 |

*Primary Examiner*—David T. Fidei

*Attorney, Agent, or Firm*—John D. Lister

[57] ABSTRACT

A basket-type carrier in which the cells are longer than they are wide in order to receive articles which are elongated in transverse cross section. The blank for forming the carrier contains spaced centrally located support panel sections which are foldably connected to riser panel sections and to the ends of partition straps. The folds connecting the center support panel sections to the partition straps are located between the folds connecting the side panels to the end panel sections and the folds connecting the end panel sections to the riser panel sections.

10 Claims, 4 Drawing Sheets

FIG. 5
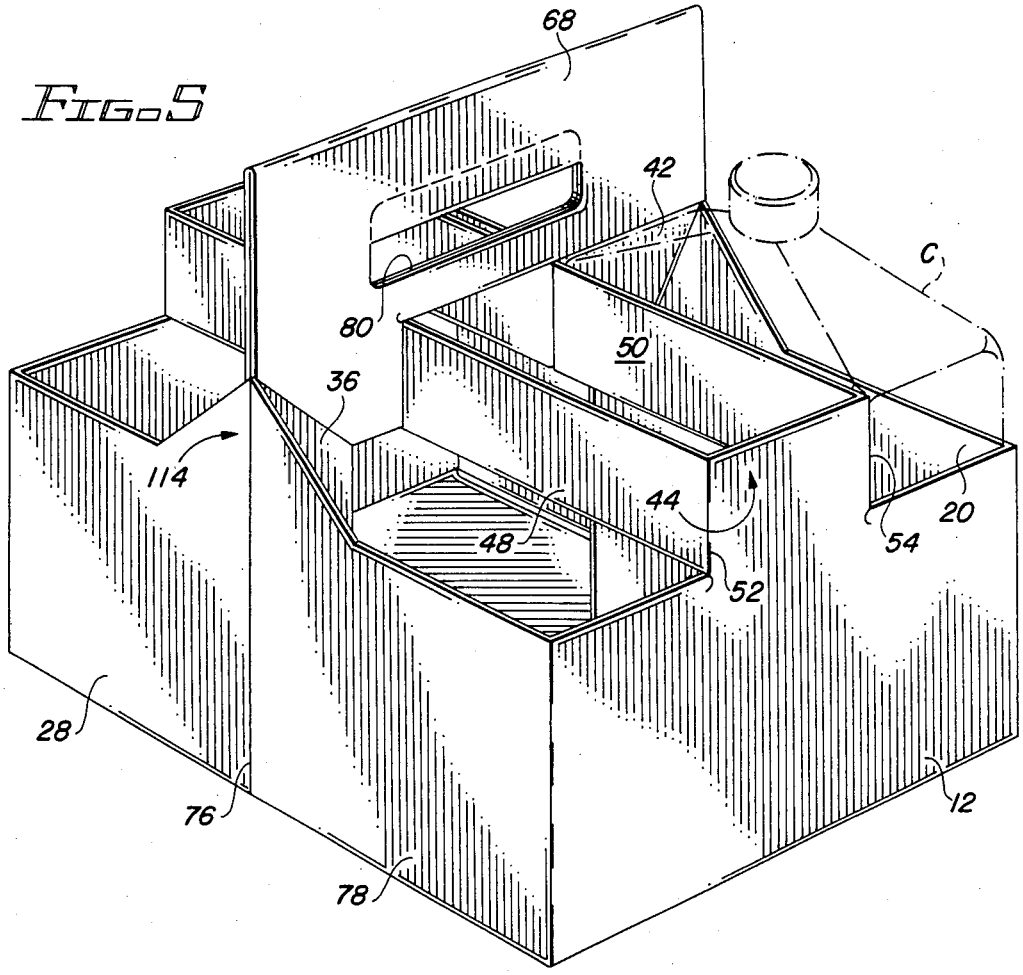
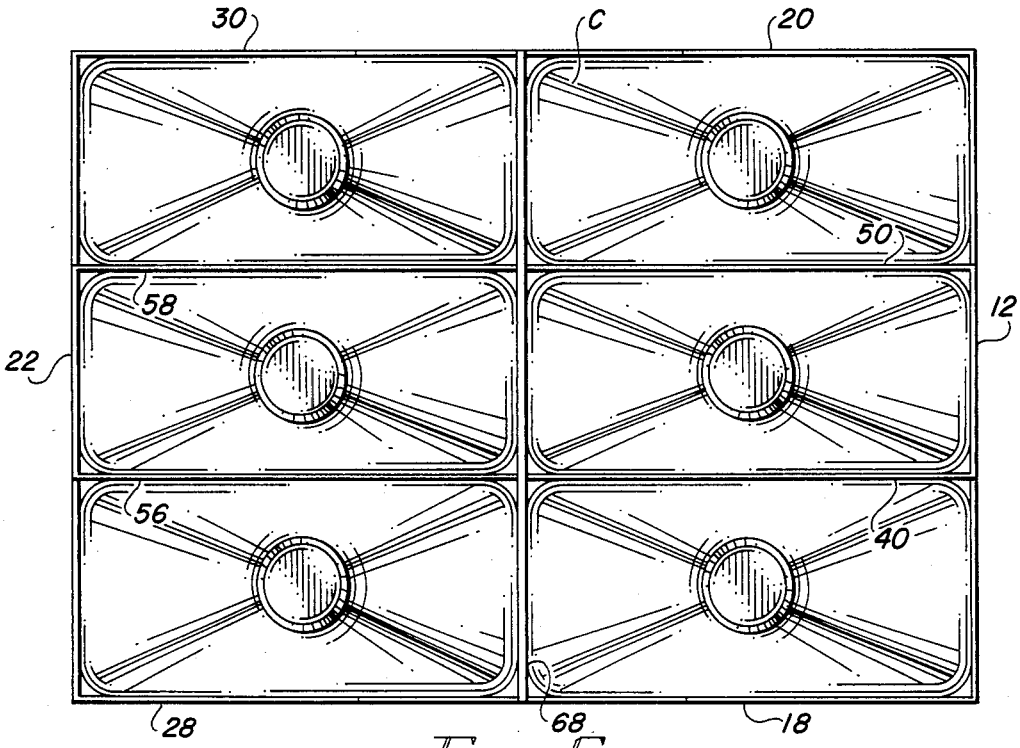
FIG. 6

BASKET-TYPE CARRIER FOR ELONGATED ARTICLES

FIELD OF THE INVENTION

This invention relates to basket-type article carriers. More particularly, it relates to a basket-type carrier adapted to carry articles which are elongated in cross section.

BACKGROUND OF THE INVENTION

Basket-type carriers are commonly used to carry articles which are of uniform dimension in cross section, that is, articles which have either a circular or square cross-sectional shape. Beverage bottles or paper cartons which contain beverages are examples of such articles. In such designs the partition straps that divide the basket portion of the carrier into cells for receiving individual articles are approximately as long as the diameter or width of the articles, and they are spaced from the end panels of the carrier, as well as from each other, a similar distance. The resulting cells are thus able to snugly receive the articles.

In some production blanks from which basket-type carriers are formed partition straps defining the cells are foldably connected to the center support panel or handle panel. Examples of such an arrangement are disclosed in U.S. Pat. No. 3,814,237 to Forrer, which discloses a carrier having eight cells, and U.S. Pat. No. 4,402,400 to Stout, which discloses a carrier having six cells. In both disclosures partition straps extend from the side panels of the carrier to each side of the center handle support panel so as to form cells on each side of the carrier, two between the straps and the end panels and either one or two between the straps themselves, depending on whether the carrier has three or four cells on each side of the center support panel. The straps are foldably connected to the side panels as well as to the center handle support panel. The length of the partition straps, or the depth of the cells, is equal to one-half the width of the end panels, and the length of the center support panel is equal to the length of the side panels. The center support panel sections from which the center support panel is formed occupy the central area of the blank and are contiguous.

Another style of basket-type carrier employs a keel panel to which transverse partitions are connected to form the individual cells of the carrier. This design, which is illustrated by U.S. Pat. No. 4,308,950, requires a blank which uses more paperboard than does the type of carrier discussed above.

As a greater variety of materials are packaged in containers which lend themselves to being marketed in basket-type carriers, there is a demand for carriers which can hold such containers. Often, however, such containers do not have square or circular cross-sectional shapes and would not fit into conventional basket-type carriers. For example, some products such as motor oil are now being sold in generally rectangular necked plastic containers which are elongated in transverse cross section. It would be desirable to be able to package containers of this shape in a basket-type carrier incorporating cells shaped to snugly receive the containers, wherein the carrier is formed from a blank using as little an amount of paperboard as possible. This would mitigate against using a blank which requires keel panels, and would appear to rule out the use of the type of blank typified by Stout and Forrer since the required cell dimensions would obviously not permit the essential relationships between the various elements of the blanks of these patent disclosures to be maintained.

BRIEF SUMMARY OF THE INVENTION

This invention permits a basket-type carrier to be used to package articles which are elongated in transverse cross section and allows the carrier to be formed from a blank minimal size. Partition straps foldably connected to a center support panel and to the side panels of the carrier are substantially greater in length than the width of the cells, the distance between the fold line connecting the straps to the center support panel and the end panel nearest thereto being substantially less than the length of the partition straps.

The blank from which the carrier is formed comprises a generally rectangular sheet to which transversely extending bottom panel sections are foldably attached. Riser panel sections at opposite margins of the sheet are foldably connected to end panel sections located in the corner areas of the sheet. The end panel sections are foldably connected to side panels. Inner and outer center support panel sections are located adjacent to the riser panel sections and extend toward each other inwardly of the riser panel sections, the opposed ends of the center support panel sections being spaced from one another. Partition straps are connected to the side panels and to the center support panel sections by fold lines, the fold lines connecting the partition straps to the center support sections being located between the fold lines connecting the side panels to the end panel sections and the fold lines connecting the end panel sections to the riser panel sections. With this arrangement a carrier can be formed from the blank which is divided into cells, each having a length, as measured along the end panel of the carrier, greater than its width.

Other features and aspects of the invention, as well as its various benefits, will become more clear in the detailed description of the preferred embodiment which follows.

BRIEF DESCRIPTION OF THE DRAWINGS

FIG. 5 is a pictorial view of a carrier formed in accordance with the invention; and FIG. 6 is a top view of the carrier of FIG. 5, shown with rectangular containers in the cells thereof.

DESCRIPTION OF THE PREFERRED EMBODIMENT

Figure 1:
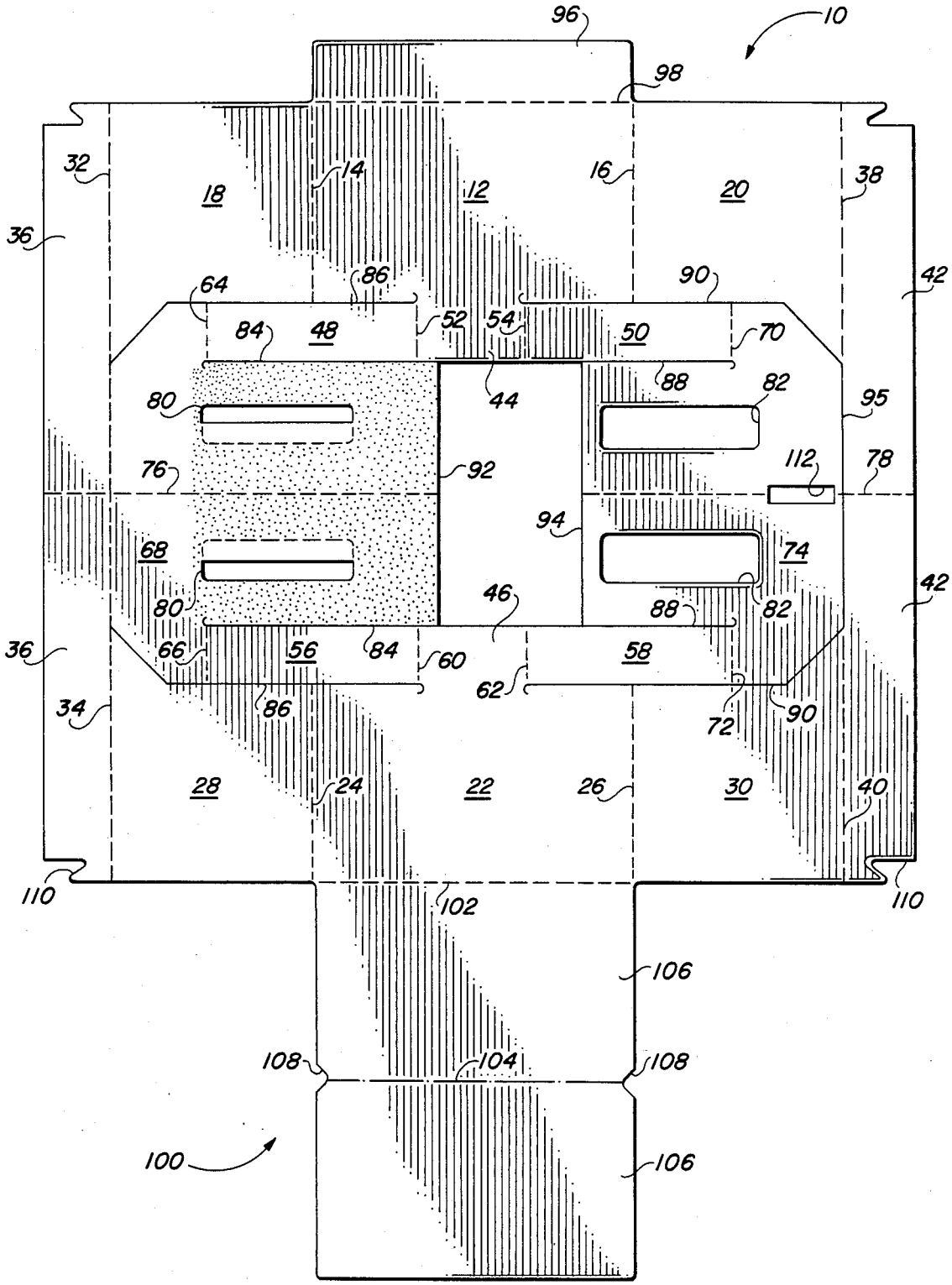
FIG. 1 is a plan view of a blank for forming a basket-type carrier in accordance with the present invention.

Referring to FIG. 1, a production blank 10 having a main body portion of generally rectangular shape, the inside surface of which faces the viewer, comprises a side panel 12 connected by fold lines 14 and 16 to end panel sections 18 and 20, respectively. Similarly, a second side panel 22 is connected by fold lines 24 and 26 to end panel sections 28 and 30, respectively. End panel sections 18 and 28 are connected by fold lines 32 and 34 to riser panel sections 36, while end panel sections 20 and 30 are connected by fold lines 38 and 40 to riser panel sections 42. The fold lines 14 and 24, 16 and 26, 32 and 34, and 38 and 40 are aligned to allow folding, as will be explained hereinafter.

The side panels 12 and 22 have centrally located rectangularly shaped projections 44 and 46, respectively. Partition straps 48 and 50 are connected to the side edges of the projection 44 along fold lines 52 and 54, and partition straps 56 and 58 are connected to the side edges of the projection 46 along fold lines 60 and 62. The opposite ends of the partition straps 48 and 56 are connected along fold lines 64 and 66 to an outer center support panel section 68. Similarly, the opposite ends of partition straps 50 and 58 are connected along fold lines 70 and 72 to an inner center support panel section 74. A fold line 76 separates the two riser panel sections 36 and the two outer center support panel sections 68 and divides the generally rectangular portion of the blank 10 in two. The riser panel sections 36 are mirror images of each other, as are the outer center support panel sections 68, enabling the sections to be folded upon each other as described in more detail hereinafter. A fold line 78 also divides the riser panel sections 42 and the inner center support panel sections 74 in the same manner as fold line 76, the fold lines 76 and 78 being aligned. The outer an dinner support panel sections contain handle openings 80 and 82 on opposite sides of the fold lines 76 and 78 to permit a handle opening to be formed in the finally formed multi-ply center support panel as explained below.

Partition straps 48 and 56 are separated from the outer center support panel sections 68 by slits 84, and from end panel sections 18 and 28 and side panels 12 and 22 by slits 86. The slits 86 also extend beyond the fold lines 64 and 66 and angle toward each other until they terminate at the fold lines 32 and 34. The angled slit portions are part of the top edges of the end panels of the carrier formed from the blank. In like manner, partition straps 50 and 58 are separated from inner center support panel sections 74 by slits 88, and from end panel sections 20 and 30 and side panels 12 and 22 by slits 90. As in the case of the slits 86, the slits 90 extend beyond the fold lines 70 and 72 and angle toward each other until terminating at the fold lines 38 and 40. The angled portions of slits 90 are part of the top edges of the opposite end panels of the carrier formed from the blank. The interior ends of outer center support panel sections 68 terminate in an edge 92 in the central portion of the blank 10, and the interior ends of inner center support panel sections 74 terminate in the central portion of the blank in an edge 94 spaced from the edge 92. The outer ends of the outer center support panel sections 68 are foldably connected to the fold lines 32 and 34 on either side of the fold line 76. The outer ends of the inner center support panel sections 74 terminate in a slit 95 which separates the sections 74 from the riser panel sections 42 on either side of the fold line 78, the slit 95 being aligned with the fold lines 38 and 40.

A glue flap 96 is connected to the outer edge of the side panel 12 by a fold line 98, and bottom panel 100 is connected to the outer edge of the side panel 22 by fold line 102. The bottom panel 100 is divided in half by score line 104 to form two bottom panel sections 106. The bottom panel may be notched at the ends of the score line 104 as at 108 for subsequent engagement with hooks or tabs formed from cutouts 110 in the riser panel sections. The bottom panel sections thus are connected so as to extend transversely of the generally rectangular main body portion of the blank.

Figure 2:
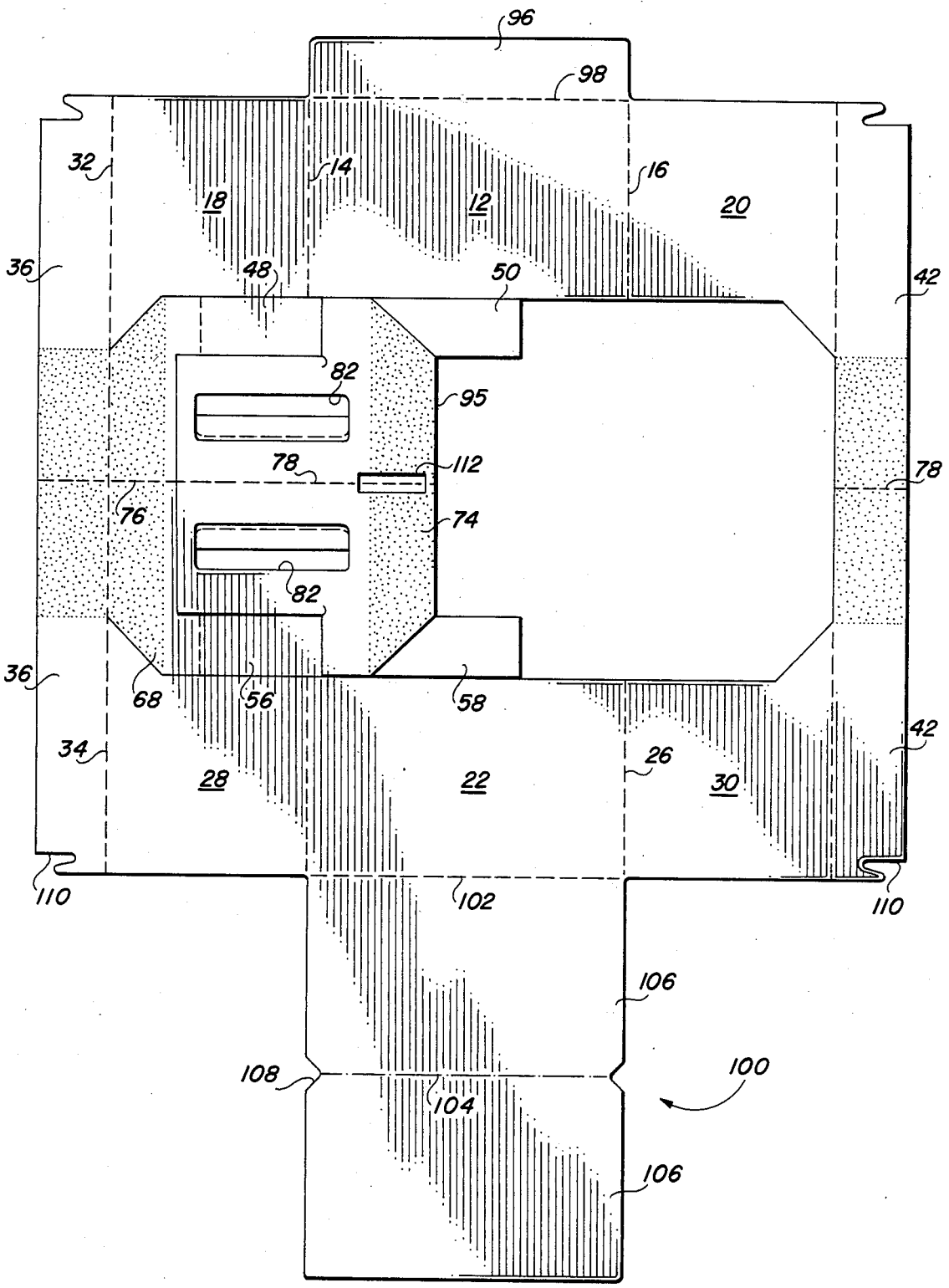
FIGS. 2, 3 and 4 are plan views of the blank of FIG. 1 in subsequent stages of formation in the forming of a basket-type carrier.

To form the carrier, adhesive is first applied to the outer center support panel sections 68 in the stippled area shown in FIG. 1. The inner support panel sections 74 are then elevated out of the plane of the blank, causing the partition straps 50 and 58 to pivot upwardly about their fold lines 54 and 62. At the same time the sections 74 are caused to remain substantially parallel to the plane of the blank by relative downward pivoting movement between the sections 74 and the fold lines 70 and 72 at the opposite ends of the partition straps 50 and 58. The end result of these movements is to pivot the inner center support panel sections 74 so that the outer surface thereof is engaged with the s tipped inner surface of the outer center support panel sections 68, the handle openings being aligned with each other as shown in FIG. 2. The length of the outer center support panel sections 68 is equal to the length of the side panels 12 and 22, and is greater than the length of the inner center support panel sections 74. The shorter length of the sections 74 allows space for the subsequent folding of the riser panel sections 36. Even with this difference in length, the outer and inner support panel sections 68 and 74 are spaced from each other in the original blank shown in FIG. 1 in order to be able to form cells which can receive articles that are elongated in transverse cross section.

Still referring to FIG. 2, the next step in the formation of the carrier is to apply adhesive to the stippled areas of the inner and outer center support panel sections 68 and 74, as well as to the stippled areas of the central portions of the riser panel sections 36 and 42. The riser panel sections 36 are then folded along fold lines 32 and 34 so as to engage the sections 68, and the end panel sections 20 and 30 are folded along fold lines 16 and 26 to cause the riser panel sections 42 to engage the inner center support panel sections 74. A cutout 112 in the inner center support panel sections 74 along fold line 78 adjacent the edge 95 is aligned with the fold line 78 in the riser panel sections 42 to reduce the layers of material at this point so as not to interfere with the subsequent folding process.

Figure 3:
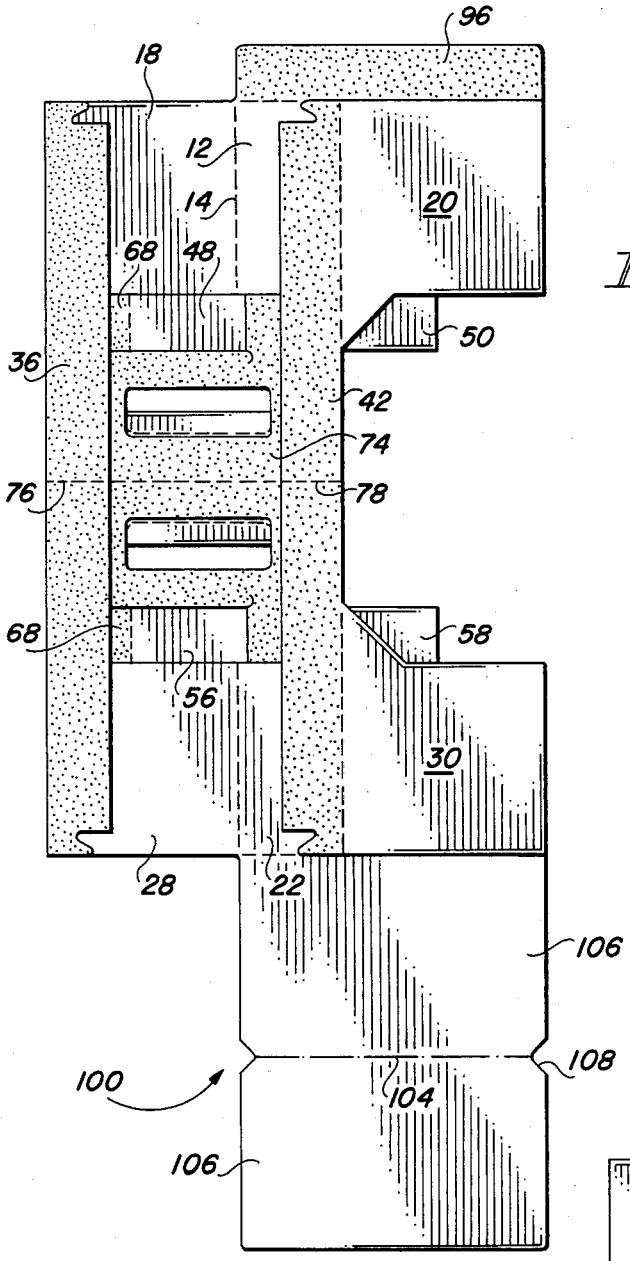

The result of this action is illustrated in FIG. 3. The next step in the formation of the carrier is to apply adhesive to the stippled areas of the riser panel sections 36 and 42, the center support panel sections 68 and 74, and the glue strip 96. The partially folded blank is then folded along fold lines 76 and 78 to adhere the riser panels sections together and the center support panel sections together. In addition, the lowermost bottom panel section 106 is first folded upwardly about fold line 104 so that the glue flap 96 contacts the opposite side of the edge portion of the lowermost bottom panel section after it has been folded up.

Figure 4:
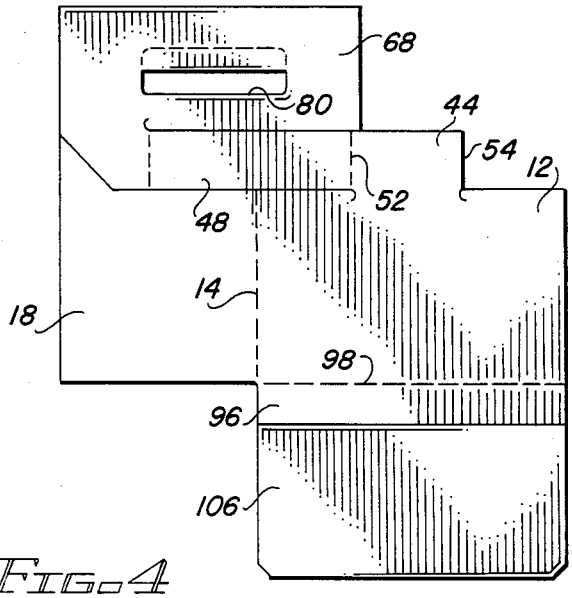

These folding and gluing actions complete the formation of the semi-formed blank, which is shown in FIG. 4. The center support panel is now generally comprised of four to six plies of paperboard and the riser panels are comprised of two plies. The partition straps are not adhered to any structure, but are foldably connected at their ends as explained above, the single strap visible in this view being strap 48. The folded and glued blank may be shipped in this condition to the packaging facility where the blank is opened to receive articles by applying pressure in an inward direction to the side edges of the blank. This action squeezes the folded blank into the carrier form shown in FIG. 5. It should be understood that the recesses 110 at the bottom of the riser panels are mated with the notches 108 at the center edges of the bottom panel of the carrier to mechanically support the bottom of the carrier.

As shown in FIG. 5, the resulting carrier has partition straps 48 and 50 foldably connected to and extending between the center support panel 68 and the side panel 12. The straps are connected to the vertical edges 52 and 54 of the projecting portion 44 of the side panel so that the straps, which form the side partitions of the center cell, are located above the main body of the side panel. The riser panels 36 and 42 extend a substantial distance inwardly from the center fold 76 of the end panel sections 18 and 28 to provide added support for the containers C, one of which is shown in phantom lines. Also, the portions of the end panels adjacent the riser panels extend upwardly to form the triangular portions 114 which terminate at the same height as the tops of the partition straps and serve to provide added support to the containers in the end cells. The triangular portions are formed as a result of the angled portions of the slits 86 and 90 discussed previously. As shown more clearly in FIG. 6, the cells of the carrier hold containers C which in the illustrated embodiment are about twice as long as they are wide.

It should now be clear that the present invention provides for a carrier adapted to hold containers which are elongated in cross section. The carrier further is formed from a blank of minimum area, representing a significant cost saving. The foldably connections between the partition straps and the center support panel sections are located between the side panels and the riser panel sections, and the opposed edges of the center support panel sections are spaced a substantial distance apart, providing for a finished carrier with cells significantly longer than they are wide.

It should now be obvious that although a preferred embodiment of the invention has been described, changes to specific details of the embodiment can be made without departing from the spirit and scope of the invention as defined in the appended claims.

What is claimed is:

1. A basket-type article carrier, comprising:
- a bottom panel having side edges;
- side panels foldably connected to the side edges of the bottom panel and having end edges;
- end panels foldably connected to the end edges of the side panels;
- riser panels connected to the end panels centrally of the end panels;
- a center support panel connected to and extending between the riser panels;
- at least one partition strap extending between the center support panel and each side panel to divide the carrier on either side of the center support panel into cells for receiving articles to be carried, the cells having a depth corresponding to the distance between the center support panel and the side panels and a width corresponding to the distance between the partition straps and the end panel nearest thereto;
- the partition straps being connected by fold lines to the center support panels and to the associated side panel; and
- the distance between the fold lines connecting the partition straps to the center support panel and the end panel nearest thereto being substantially less than the length of the partition straps, whereby the cells are adapted to receive articles having an elongated transverse cross-sectional shape.

2. A basket-type article carrier according to claim 1, wherein the center support panel contains a handle openings.

3. A basket-type article carrier according to claim 1, wherein the riser panels are substantially parallel to the side panels and form support surfaces for articles in cells adjacent the end panels.

4. A basket-type article carrier according to claim 1, wherein there are two partition straps extending between the center support panel and each side panel.

5. A basket-type article carrier according to claim 4, wherein each side panel has an upwardly extending centrally located projection having end edges, the partition straps being foldably connected to the end edges of the projections.

6. A production blank for forming a basket-type article carrier, comprising:
- a sheet having a generally rectangular main body portion;
- riser panel sections at two opposite margins of the main body portion of the sheet;
- end panel sections in corner area of the main body portion of the sheet adjacent to and inwardly of the riser panel sections, each end panel section being connected to the adjacent riser panel section by a fold line;
- a pair of side panels connected to the end panel sections by fold lines substantially parallel to the fold lines connecting the riser panel sections to the end panel sections;
- a pair of generally similarly shaped outer center support panel sections adjacent the riser panel sections at one margin of the main body portion of the sheet and a pair of generally similarly shaped inner center support panel sections adjacent the riser panel sections of the opposite margin, the two paris of center support panel sections extending toward each other between the end panel sections and the side panels;
- bottom panel means extending transversely of the main body portion of the sheet and being connected to one of the side panels along a fold line; and
- partition straps connected to the side panels by fold lines and to the center support panel sections by fold lines located between the fold lines connecting the side panels to the end panel sections and the fold lines connecting the end panel sections to the riser panel sections;
- whereby when the blank is formed into a carrier, the carrier is divided into cells, each having a depth, as measured along the end panels of the carrier, greater than its width.

7. A production blank according to claim 6, wherein the outer and inner center support panel sections are spaced from each other.

8. A production blank according to claim 7, wherein the outer and inner center support panel sections are spaced from each other a distance greater than the width of the riser panel sections.

9. A production blank according to claim 7, wherein the side panels have projecting portions extending toward each other, the projecting portions having end edges coinciding with the fold lines connecting the partition straps to the side panels.

10. A production blank according to claim 9, wherein the center support panel sections contain handle openings positioned so as to register when the blank is folded to form a carrier.

* * * * *